US005383533A

United States Patent [19]

Nikula et al.

[11] Patent Number: 5,383,533

[45] Date of Patent: Jan. 24, 1995

[54] LADDER CLAMPING DEVICE

[76] Inventors: Dale Nikula, 35 Park St., Harwich, Mass. 02645; Brian Shanahan, 32 Goff Ter., Centerville, Mass. 02632

[21] Appl. No.: 197,111

[22] Filed: Feb. 16, 1994

[51] Int. Cl.[6] ..... E06C 7/48

[52] U.S. Cl. ..... 182/107; 182/214; 248/231.7

[58] Field of Search ..... 182/107, 214; 248/231.7, 231.4, 316.4, 316.6

[56] References Cited

U.S. PATENT DOCUMENTS

| | | | |
|---|---|---|---|
| 1,374,060 | 4/1921 | Chute | 182/107 X |
| 2,256,452 | 9/1941 | Marshall | 182/214 |
| 3,131,900 | 5/1964 | Anderson | 248/210 |
| 3,853,202 | 12/1974 | Jarboe | 182/214 X |
| 4,957,257 | 9/1990 | Gonzaley | 248/231.7 |

FOREIGN PATENT DOCUMENTS

| | | | |
|---|---|---|---|
| 58548 | 3/1941 | Denmark | 248/231.7 |

*Primary Examiner*—Alvin C. Chin-Shue
*Attorney, Agent, or Firm*—Thomas A. Kahr

[57] ABSTRACT

A ladder clamping tool for holding a ladder in a fixed position relative to a rain gutter attached to the eaves of a roof and releasing therefrom. The ladder clamping device includes a screw driver handle defining an axis, a threaded shaft extending along the axis from the handle, terminating with a swivel joint for movably engaging a moveable clamping bar mounted on the swivel joint for engaging the ladder in a slanted position. The ladder clamping tool includes a fixed gutter plate for engaging an interior wall of said gutter mounted at one end of an elongated post wherein as the screw driver handle turns, which is configured to turn the shaft in a threaded socket for moving and holding said clamping bar relative to the fixed gutter clamp, pressure is applied on said gutter clamp, said clamping bar, and on the objects being clamped such as a leg of a ladder and a rain gutter.

6 Claims, 1 Drawing Sheet

LADDER CLAMPING DEVICE

BACKGROUND OF THE INVENTION

The present invention relates to a ladder clamping device for use with gutters attached to eaves at the lower edge of a roof. More particularly, the invention relates to a safety clamp for use in securing a ladder typically set at an angle, to a roof gutter which is easy to install and remove yet provides a secure anchoring of the ladder to the gutter or the eaves trough.

Aluminum gutters are commonly used on modern structures which are well secured to the building and employ a contoured outer wall having a top lip to provide structural strength together with an ornamental appearance. Commonly being coated with a glossy finish, typically white enamel paint, the gutters are often very slippery thereby causing a dangerous condition in that a ladder propped against the gutter tends to slide along the gutter when in use posing a substantial risk of falling to the user. Also the configuration of a gutter varies from manufacturer to manufacturer. Furthermore, for safety reasons, it is common for a user to use one hand to hold onto the ladder for stability and it is therefore desirable to have a ladder clamping device that is operable with one hand only leaving the other to hold the ladder.

Applicant is aware of prior art ladder supports. For example, as are shown in the following U.S. Pat. Nos.: 3,853,202, JARBOE; 4,601,365, DAVIS; 4,013,251, CLEVELAND; 4,714,136, MORIN; 3,909,889, EMERSON; and 4,444,291, McPHERSON.

JARBOE U.S. Pat. No. 3,853,202 shows a bracket having outer flanges clamping to a side wall of a ladder. The bracket being secured to the ladder by the clamping of a pair of bolt assemblies.

EMERSON U.S. Pat. No. 3,909,889 shows an upstanding arm having front slots and rear slots for adjustment of an elongated arm and includes a jack screw device for clamping an object.

Unlike prior art devices, applicant's invention employs a novel movable flat clamp face that is swivel mounted for providing greater area of contact on a slanted leg of a ladder in association with a fixed curved clamp face providing multiple contact points on the contoured interior of a gutter to provide a safe and secure connection. Accordingly, it is desirable to provide for a new and improved Ladder Clamping Device to provide for improved clamping action, greater safety features, ease of use without sacrificing safety, and which overcomes at least some of the disadvantages of prior art.

SUMMARY OF THE INVENTION

The present invention is directed to a ladder clamping tool for holding a ladder in a fixed position relative to a rain gutter attached to the eaves of a roof and for release therefrom.

In particular the invention is directed to a ladder clamping device including a post having a threaded surface to which is affixed at one end a fixed gutter clamp having a concave curved face plate extending in perpendicular relationship to the post. Said post also includes an arm having a threaded socket at one end and being connected at the other end to the post in sliding engagement therewith adapted for reciprocal movement between a clamping position and a release position and a shaft extending in coplanar relationship with the post having one end to which is attached a movable clamping bar including a flat face plate and having a screw driver handle attached to the other end. In the present invention said clamping bar is mounted on a swivel and positioned in parallel relationship with said gutter clamp. The ladder clamping tool is typically operated by rotating the screw driver handle which turns the shaft in the threaded socket moving and holding the movable clamping bar relative to the fixed gutter plate whereby turning the handle applies pressure to the gutter clamp and clamping plate and to the ladder surface. The ladder leg is then clamped to the rain gutter.

In the preferred embodiment, the ladder clamping tool includes an elongated post including a movable arm support having a threaded surface, a control end and an object engaging end on which is mounted the movable clamping bar for engaging an angled face of a leg of the ladder, said ladder being propped against a gutter. In this embodiment, a screw driver handle is provided on the control end of the shaft such that by twisting the handle the movable clamping bar is moved relative to the fixed gutter plate and clamping is accomplished by drawing the clamping bar and gutter plate together by this twisting action.

The handle of the present invention consists of a screw driver handle defining an axis connected to the shaft extending along the axis from the handle. The shaft includes formed threads extending between said handle and extending to the object engaging end. The shaft terminates with a swivel joint connected to the clamping bar which is arranged in orthogonal relationship thereto. The clamping bar is mounted on the swivel joint for orientation to engage an angled surface of a selected leg for holding the ladder. The moveable clamping bar also includes a safety tab extending from the inner end of the clamping bar arranged in orthogonal relationship thereto engaging the outer edge of the ladder leg to brace the ladder in position and to prevent slide transverse slippage. The clamping bar is therefore adapted to engage two separate surfaces of the ladder to provide secure engagement and to hold the ladder in fixed relationship with the gutter when drawn toward the gutter clamp.

In the present invention, the gutter plate is attached to the distal end of the post extending in fixed perpendicular relationship to and is configured to be inserted into the inner cavity of the rain gutter for clamping to the outer wall of the rain gutter. This outer wall of the rain gutter is contoured to provide multiple curved surfaces amid the contour ridge and a top lip. The gutter plate has a concave curved face plate and is attached at one end along the upper peripheral edge thereby providing an extended, unobstructed, clamping surface that is adapted to engage the gutter lip at a mid section. The upper curved ridge at the lower distal edge provides two areas of contact extending longitudinally along the gutter. The concave face plate is coated with a rubberized compound to provide a gripping surface.

In the present invention, the elongated post extends at a right angle from the curved face of an end segment of the gutter plate having a one and other end. A movable arm is mounted on the elongated post having a one and other end. The one end including a tubular collar with internal threads. The other end is mounted in a sliding engagement on the post. A lock mount is positioned on the arm member and is provided for slidably adjusting the position of the arm along the axis of the post having a compression member which moves between a compressed position and a released position.

In the present invention, the swivel means consists of a ball member and a socket member. The ball member is attached to the distal end of the rod. The socket is provided in the other surface of the clamping plate positioned at a mid position for swivel mounting the clamping bar in parallel alignment and in full contact with the outer face of a selected leg of the ladder for compressing the ladder against the gutter in fixed relation thereto. In the preferred embodiment, the screw handle is employed as an actuating means for manual operation of the tool with one hand, for moving the clamping bar between a clamping position and a release position. The handle, being characterized by an enlarged cylindrical handle, resides on the prominent end of the rod. In the preferred embodiment, the clamping plate is configured as a curved plate member having an inner concave surface and an outer convex surface being attached along one end of the inner convex surface. In the preferred embodiment, the locking mount includes a release member for disengaging the arm member from the post permitting the clamping plate to move along the post for permitting disengagement of the leg of the ladder.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
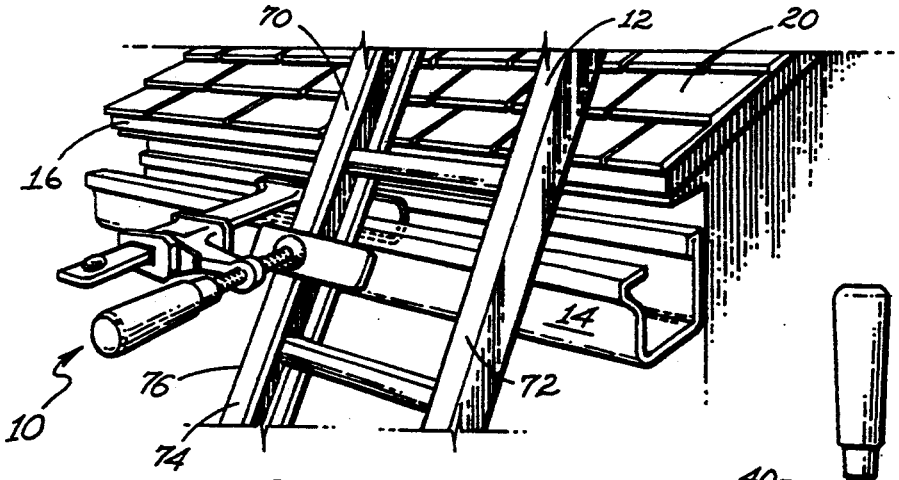
FIG. 1 is a perspective view of the ladder clamping tool of the present invention illustrating the manner in which it engages a leg of a ladder and a gutter.
Figure 2:
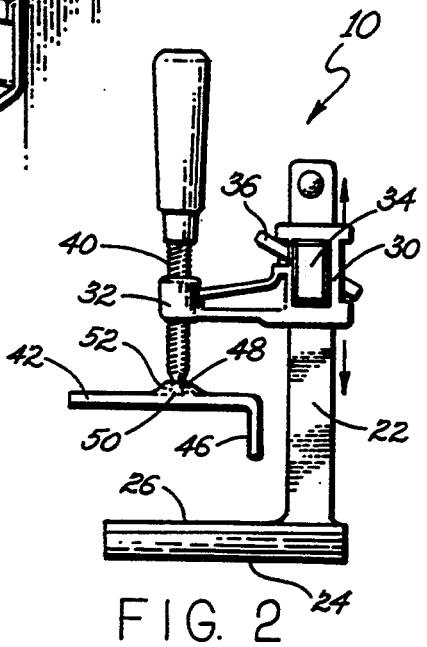
FIG. 2 is a side view of the clamping tool of the present invention of FIG. 1.
Figure 3:
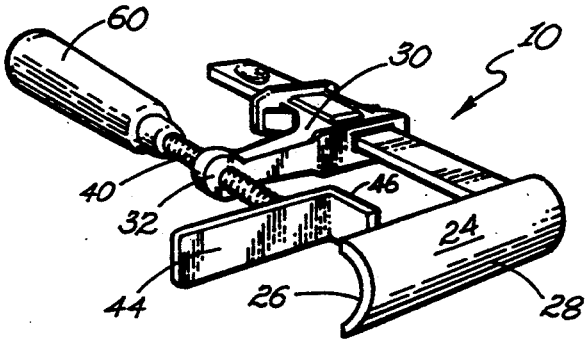
FIG. 3 is an elevational view from above of the clamping tool of the invention of FIG. 1 showing the flat face plate and the convex curved face plate.
Figure 4:
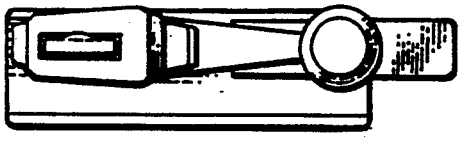
FIG. 4 is a top view of FIG. 2 of the invention of FIG. 1.
Figure 5:
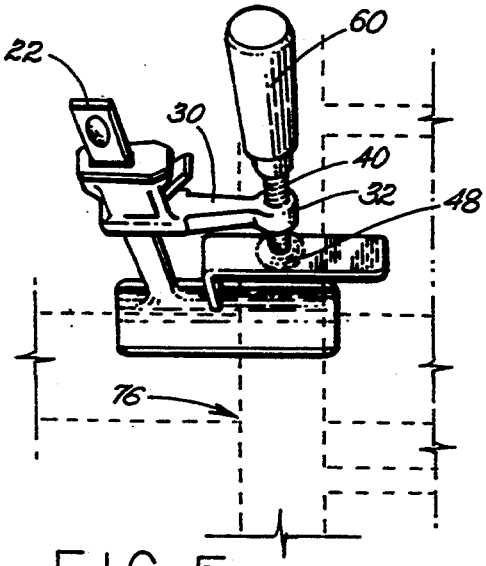
FIG. 5 is a perspective view of the invention of FIG. 1 shown with the tab of the clamping plate extending down along the side of the leg of the ladder shown in dotted lines and the face plate extending along the top thereof.

Referring to the drawings, there is shown a clamping tool 10 securely fastened to a ladder 12 positioned in angled relationship with a gutter 14. Said gutter is shown in FIG. 1 as extending horizontally along the projecting overhang of one of the eaves 16, of a roof 20. Referring to FIG. 2, the ladder clamping tool includes a post 22 having a first and second end, the first end provided with a fixed gutter clamp 24 extending in fixed perpendicular relationship to said post, said clamp having a concave face plate 26 and a convex exterior surface 28.In the preferred embodiment, the concave face plate is depicted as a 3" long half circle, 1" in diameter.

As is shown in the Figs., more particularly FIG. 2, an arm member 30 is mounted on the post 22 at one end and includes a threaded socket 32 and further includes a locking mount 34. As is shown in FIG. 2, said locking mount includes a release bar 36 for engaging and disengaging the post 22 thereby permitting the arm member 30 to move along said post reciprocally, forward and away from the gutter clamp 24.

In the preferred embodiment, a shaft 40 is positioned in coplanar relationship with the post 22 having a first and second end the first end being provided with a clamping bar 42 consisting of a flat face plate 44 and an orthogonally extending safety tab 46. Said clamping bar is mounted on the distal end of shaft 40 on a swivel device 48 which includes a ball 50 and a socket 52 positioned in a mid section of the clamping bar 42.

As is shown in the Figs. a screw driver handle 60 is positioned at the other end of shaft 40 which turns said shaft 40 in the threaded socket 32 for moving said clamping bar relative to the gutter clamp 24 and holding said clamping bar in fixed relationship with the gutter 14.

Figure 6:
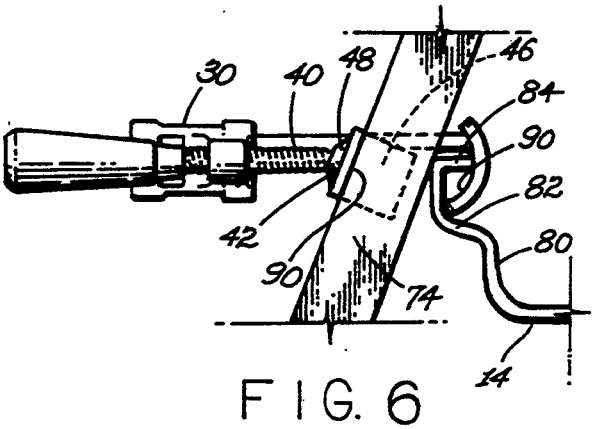
FIG. 6 is a side elevational view of the invention of FIG. 1 showing the clamping plate oriented in parallelled relationship with the slanting top of the ladder leg and shows the ladder clamping plate engaging two areas of the gutter shown in cross-section.

As is shown in FIG. 1, the ladder 12 includes a first leg 70 and a second leg 72 each leg having a longitudinal planar face 74 and a side 76. As is shown in FIG. 6, the gutter 14 is formed with a lower contour 80, an upper contour 82 and a lip 84. Wherein the clamped position in FIG. 6, the swivel device 42 permits flat face plate 44 coated with rubberized material 90 clamp bar 42 to align with the slanted longitudinal face 74 of the leg 70 with safety tab 46 along side 76 and with gutter clamp 24 extending inside the gutter 14 with concave face plate 26, being coated with a rubberized coating 90, in contact with lip 84 and upper contour 82.

What is claimed is:

1. A ladder clamping safety device securing a ladder to a rain gutter of a house and for release therefrom comprising:

a) the rain gutter extends horizontally and includes an outer contoured wall having a contoured lip defining a vertical plane;

b) the ladder is positioned in angled relationship with said vertical plane and includes a pair of legs arranged in slanted relationship to said vertical plane and comprising a first and second leg each leg having a longitudinal top and a lateral edge;

c) a post having a first and second end;

d) a gutter plate means for simultaneous engaging an inner edge of the contoured lip and an inner surface of the said contoured wall of the said rain gutter comprising a recessed plate having a one and other end, the one end fixedly mounted on the second end of said post extending in perpendicular relationship thereto;

e) clamping bar means for engaging a selected leg of the ladder having a flat face plate positioned in coplanar relationship with the front surface of said leg and in angled relationship with the said gutter plate means, wherein said clamping bar means is connected by swivel means to a threaded shaft extending in coplanar relationship with the post having a first and second end, the first end being provided with a handle means and the second end supporting the swivel means; and f) an arm member having a first and second end the first end provided with a threaded socket and the second end connected in sliding engagement to said post for reciprocal movement between a clamping position and a release position; wherein as the screw driver handle is manually turned, the shaft turns in the threaded socket for moving and holding said clamping bar means relative to the fixed gutter plate means and applies pressure on the objects being clamped including the leg of the ladder and the rain gutter.

2. The ladder clamping safety device of claim 1 wherein the arm member includes a locking mount having a release member for engaging and disengaging the arm member from the post member permitting the arm member to move along the post between a clamping position and a release position.

3. The ladder clamping safety device of claim 1 wherein the recessed plate and the flat face plate are coated with rubberized material.

4. The ladder clamping safety device of claim 1 wherein the screw driver handle comprises an enlarged cylindrical handle and resides on a distal end of the threaded shaft.

5. The ladder clamping safety device of claim 1 wherein the clamping bar means consists of a flat face plate for engaging the angled longitudinal top of a leg of the ladder and a orthogonally arrayed safety tab for engaging the side of said leg for additional support.

6. The ladder clamping safety device of claim 1 wherein the arm member includes a locking mount having a release member for disengaging the arm member from the elongated post member permitting the moveable face plate to move along the post for engaging and disengaging a leg of the ladder.

* * * * *